United States Patent [19]

Coop

[11] 3,931,904

[45] Jan. 13, 1976

[54] TEAR-OFF CLOSURE

[76] Inventor: Jackie Allen Coop, P.O. Box 94, New Lisbon, Ind. 47366

[22] Filed: Dec. 11, 1974

[21] Appl. No.: 531,627

[52] U.S. Cl. ..... 215/254; 215/305

[51] Int. Cl.[2] ..... B65D 41/42

[58] Field of Search ..... 215/253, 254, 255, 256, 215/304, 305; 220/270

[56] References Cited

UNITED STATES PATENTS

| | | | |
|---|---|---|---|
| 1,874,208 | 8/1932 | Reardon | 215/304 |
| 2,490,791 | 12/1949 | Erb | 215/305 |
| 3,216,602 | 11/1965 | Kill | 215/254 |

*Primary Examiner*—Donald F. Norton
*Attorney, Agent, or Firm*—Woodard, Weikart, Emhardt & Naughton

[57] ABSTRACT

A sheet metal closure is provided which has a tear strip across its skirt and a pull ring below the bottom edge of the skirt and integrally connected to the tear strip to facilitate severance of the score lines which define the tear strip. The pull ring is in the form of a bead which is curled inwardly from the connection of the ring to the tear strip and is adapted to be cammed against the neck of the container below the connection to the tear strip so the end of the tear strip will be partially wrapped around the curled bead when the tab is lifted to initiate severance of the score lines.

14 Claims, 5 Drawing Figures

TEAR-OFF CLOSURE

BACKGROUND OF THE INVENTION

Field of Art

This invention relates to closures and containers, and in particular to a tear-off closure having an integral pull ring attached to a tear strip across the skirt of the closure with the pull ring adapted to initiate severance of the score lines defining the tear strip when the pull ring is lifted from around the bottle neck.

Brief Description of the Prior Art

Millions of bottles of beer and beverage are sold every year which are sealed with metal caps or closures. Many of the caps are of the crown type which require a bottle opener or other tool to remove the caps from the bottles on which they are sealed. In recent years, increasing numbers of bottles are being sold with threaded closures which can be removed without the need for a bottle opener. However, these threaded closures require a special glass finish and cannot be applied on bottles which are adapted to receive crown closures, and there are millions of crown type bottles in use. A closure is therefore desired which can be applied on a bottle adapted to receive a crown closure, and which can be removed from the bottle without the need for a bottle opener. Roll-on crown closures with integral ring tabs and a tear strip across the closure skirt and top panel are known as is disclosed in U.S. Pat. No. 3,380,609. Closures are also known having a body portion with a concentrically disposed pull ring therearound and integrally connected to the body portion as is disclosed in U.S. Pat. Nos. 2,443,185 and 2,490,791. However, the closures disclosed in those patents have had little or no commercial success.

A tear-off closure is desired which can be sealed on a bottle which is adapted to receive a crown closure and which can be easily removed by the consumer.

SUMMARY OF THE INVENTION

This invention provides a sheet metal closure which is adapted to be secured on a container for receiving crown closures and which includes a top panel, a depending skirt around the top panel and a pull ring concentric with the bottom edge of the closure skirt and integrally connected to a tear strip across the closure skirt. The pull ring comprises a bead which is curled inwardly from the connection to the tear strip and which is adapted to be cammed against the bottle neck below the connection to the tear strip when the pull ring is lifted so the tear strip will be partially wrapped around the bead to initiate severance of the score lines which define the tear strip.

Accordingly, an object of this invention is to provide a tear-off closure which is adapted to be sealed on a container finish for receiving crown closures.

Another object of this invention is to provide a metal closure having an inwardly curled bead around the closure skirt which forms a pull ring for severing the score lines defining a tear strip across the closure skirt.

The above and other objects and advantages of this invention will be more fully understood and appreciated with reference to the following description and the drawings appended hereto.

DESCRIPTION OF A PREFERRED EMBODIMENT

Figure 1:
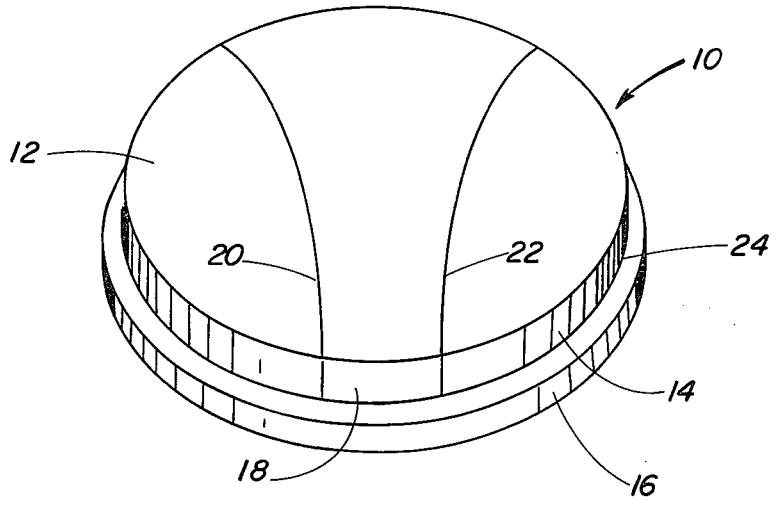
FIG. 1 is a perspective view of a closure of this invention.

FIG. 1 illustrates a tear-off closure of this invention which is made of sheet metal and preferably of sheet aluminum or an alloy thereof which may have a thickness of a range of approximately 0.007 inch to 0.012 inch. The closure 10 includes a top panel 12 which is adapted to overlie the entrance mouth of a container, a closure skirt 14 depending from the periphery of the top panel and an integral pull ring 16 around the bottom edge of the closure skirt and projecting outwardly and downwardly from such bottom edge. The closure 10 further has a tear strip 18 which extends at least across the closure skirt and preferably also across a major portion of the top panel 12 of the closure. The tear strip is defined by two score lines 20 and 22 across the closure skirt 14 and top panel 12. The pull ring 16 is integrally connected to the outer end of the tear strip 18 at the bottom of the closure skirt. Frangible means 24 such as a score line or a plurality of spaced slits and bridges preferably connect the pull ring to the remaining portion of the closure skirt prior to application of the closure on a container mouth. Such frangible means 24 is adapted to be severed or broken when the closure is sealed on a container by crimping or otherwise constricting a portion of the closure skirt inwardly toward the container neck.

Figure 2:
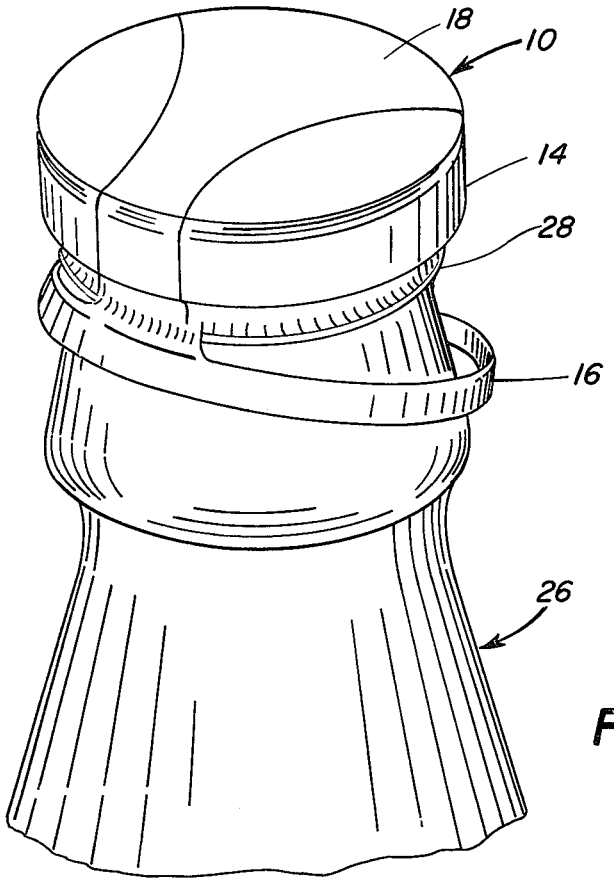
FIG. 2 is a perspective view of a closure of this invention sealed on a container mouth.

FIG. 2 shows the closure 10 sealed on a container mouth 26 with a lower portion 28 of the closure skirt 14 constricted toward the container neck and under an outwardly projecting annular bead around the container entrance mouth. As sealed on the container, the pull ring 16 is connected to the closure through the tear strip 18. The frangible means which previously connected the pull ring to the remaining portion of the closure skirt was severed when the closure was sealed on the container. The pull ring 16 is disposed closely adjacent the container at the attachment of the ring to the tear strip 18 and is inclined downwardly from such attachment to the free end of the ring on the side of the container opposite the attachment.

Figure 4:
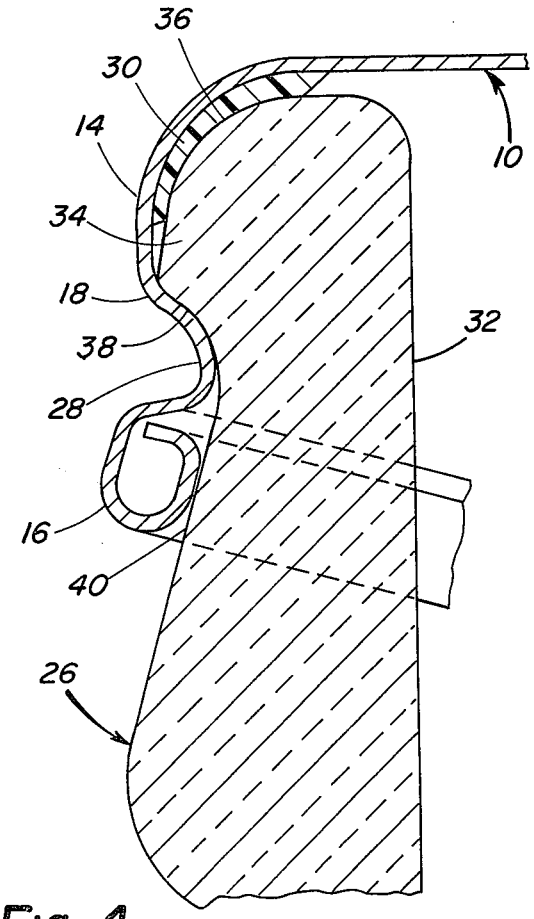
FIG. 4 is a fragmentary cross sectional view through a container mouth and a closure of this invention sealed thereon.

FIG. 4 is a cross section through a portion of the closure 10 and container 26 taken through the tear strip 18 and showing the integral pull ring 16 connected to the tear strip. The container 26 has a generally cylindrical, upwardly projecting neck portion 32 with an entrance mouth therethrough and an externally disposed, outwardly projecting, annular bead 34 around the top of the neck portion. The container bead 34 has an upwardly-outwardly facing rounded upper surface 36 and a generally downwardly facing undersurface 38. Such a container finish is typical of the finishes on which crown type closures are usually sealed.

The closure 10 has a gasket material or sealing material 30 therein which is compressed against an upwardly-outwardly facing surface 36 on the container bead 34 to provide a seal between the closure and container. The constricted portion 28 of the closure skirt locks the closure on the container and holds the sealing material 30 under compression to provide an effective seal between the closure and container.

As is illustrated in FIG. 4, the pull ring 16 is in the form of a bead curled inwardly from its connection to the tear strip 18. The curled bead is preferably substantially oval or elliptical in cross sectional configuration with its major axis substantially parallel to the exterior surface of the container mouth inwardly of the bead. The oval cross sectional configuration of the bead helps to cam the terminal end of the tear strip outwardly to initiate severance of the score lines in the closure skirt as will be described.

Figure 5:
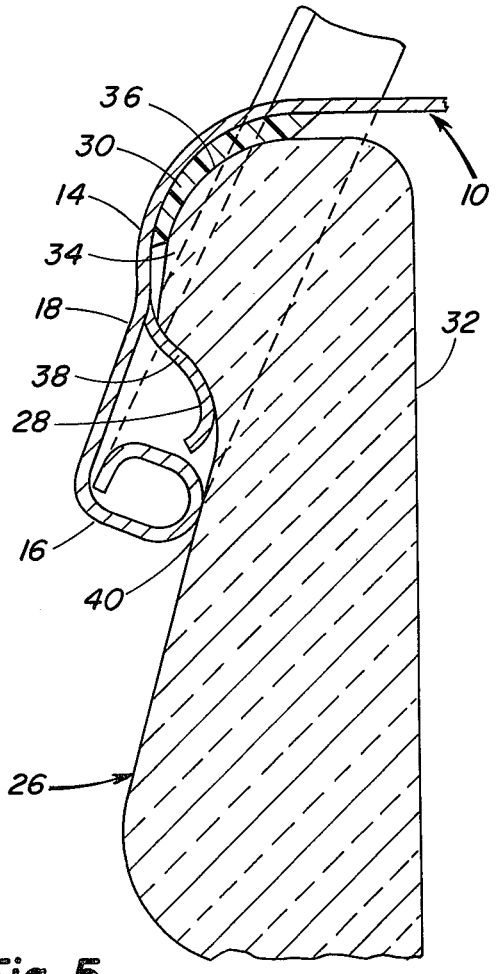
FIG. 5 is a cross sectional view similar to FIG. 4 and further showing the closure after the pull ring has been lifted to initiate severance of the score lines in the closure skirt.
Figure 3:
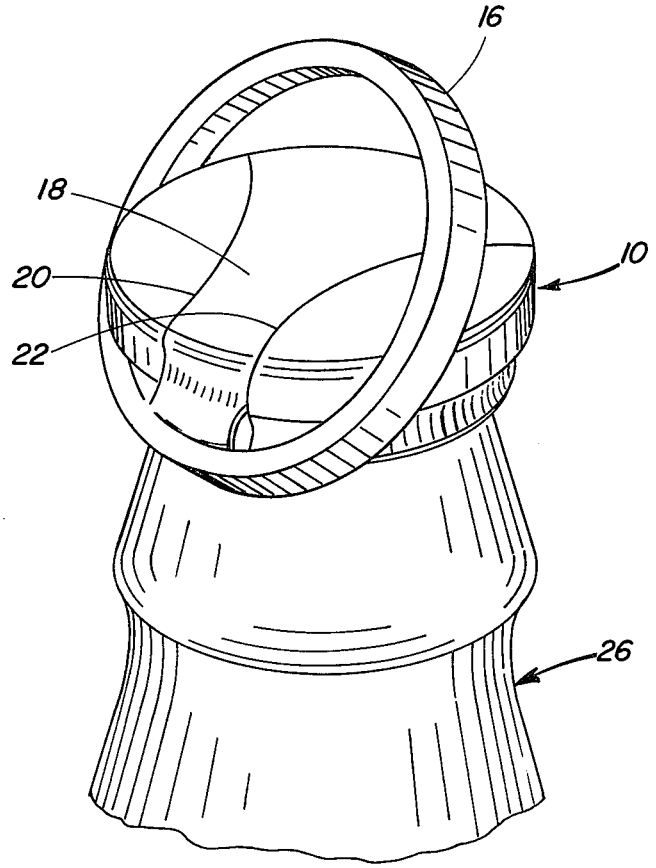
FIG. 3 is a perspective view similar to FIG. 2 and further illustrating the pull ring after it has been lifted from around the bottle neck to initiate severance of the score lines in the closure skirt.

The pull ring 16 is disposed around the container neck 26 below the bottom edge of the closure skirt 14 and is adapted to engage the container neck when the opposite or free end of the pull ring is lifted from around the bottle neck to the position illustrated in FIGS. 3 and 5. The curled bead which forms the pull ring 16 is substantially rigid so it will not be materially deformed when the free end is lifted. Instead, lifting the free end of the pull ring 16 engages the curled bead against the outwardly facing surface on the container neck and turns or rotates the bead from its initial position with its major axis parallel to the outwardly facing surface 40 of the container neck 32 to a position in which the bead's major axis is substantially perpendicular to surface 40. Such rotation of the bead partially wraps or winds the tear strip 18 about the inwardly curled bead and cams the attached end of the pull ring and the terminal end of the tear strip outwardly, and initiates severance of the score lines in the closure skirt. Once rupture of the score lines has been initiated by lifting the ring, it is a simple matter for the consumer to continue to sever such score lines by pulling the ring upwardly away from the container mouth and sever the score lines across the closure skirt and across the top panel of the closure to form a partially split closure member which can be easily lifted from the container mouth. The separated closure can be discarded without risk of injury due to any contact with the severed edges of the closure.

It is seen that this invention provides a tear-off closure which is adapted to be sealed on a container for crown closures and which can be removed from the container with a minimum of effort. Although one preferred embodiment of this invention has been selected for purposes of illustration and description, it will be apparent to those skilled in the art that the closure can be modified without departing from the invention or from the scope of the appended claims.

What is claimed is:

1. A sheet metal closure adapted to be secured on a container and comprising a top panel, a depending skirt around the periphery of the top panel with a pair of weakening lines in the skirt defining a tear strip across the skirt, and a substantially rigid pull ring disposed generally beneath the bottom edge of said skirt substantially concentric with the skirt and integrally connected to said tear strip, said pull ring comprising a bead curled inwardly from the connection of the ring to said tear strip and adapted to be cammed against the neck of a container below the connection to the tear strip when the ring is lifted to partially wrap the end of said tear strip around a portion of the curled bead and initiate severance of said weakening lines.

2. A closure as set forth in claim 1 in which said curled bead in said pull ring has a generally oval cross sectional configuration with its major axis substantially parallel to the closure skirt.

3. A closure as set forth in claim 1 in which said tear strip extends across a major portion of the top panel of the closure.

4. A closure as set forth in claim 1 in which said pull ring projects radially outwardly from the bottom edge of said closure skirt.

5. A closure as set forth in claim 1 in which said closure skirt is adapted to have its bottom edge constricted radially inwardly toward a container neck to secure the closure on the container.

6. A closure as set forth in claim 1 which has frangible connecting means between the pull ring and the closure skirt for holding the ring in position around the closure until the closure is secured on a container, at which time said connecting means is severed.

7. A sheet metal closure adapted to be secured on a container having an outwardly projecting annular bead around its entrance mouth and which comprises a top panel, a depending skirt around the periphery of the top panel and a pull ring generally concentric with the bottom edge of the closure skirt, said closure skirt having a pair of weakening lines therein defining a tear strip across the skirt and said pull ring comprising a curled bead integrally connected to the outer end of said tear strip to facilitate severance of the weakening lines and removal of the closure from a container on which it is secured.

8. A closure as set forth in claim 7 in which said pull ring is inwardly curled from its connection to said tear strip.

9. A closure as set forth in claim 7 in which said tear strip extends across a major portion of the top panel of said closure.

10. A closure as set forth in claim 7 in which said curled bead has a substantially oval cross sectional configuration.

11. A container-closure combination including a container having an upwardly projecting substantially cylindrical neck portion with an entrance mouth therein and an externally disposed bead around the neck portion adjacent the entrance mouth and a closure secured on the container including a top panel over the container entrance mouth, a skirt depending from the periphery of the top panel with a portion of the skirt constricted inwardly toward the container neck below the container bead, and a substantially rigid pull ring around the container neck below the bottom edge of said closure skirt, said closure skirt having a pair of weakening lines therein defining a tear strip across the skirt and integrally connected to said pull ring which comprises a bead curled inwardly from its connection to the tear strip and which is adapted to be cammed against said container neck below the connection to the tear strip when the ring is lifted to partially wrap the end of the tear strip around a portion of the curled bead and initiate severance of the weakening lines in the closure skirt.

12. A container-closure combination as set forth in claim 11 in which said curled bead has a generally oval cross sectional configuration with its major axis substantially parallel to an adjacent outwardly facing surface on the container.

13. A container-closure combination as set forth in claim 11 in which the attached end of said pull ring is disposed adjacent the container neck below the tear strip in the closure skirt.

14. A container-closure combination as set forth in claim 11 in which said tear strip extends across a major portion of said top panel.

* * * * *